US006886295B2

(12) United States Patent
Annes et al.

(10) Patent No.: US 6,886,295 B2
(45) Date of Patent: May 3, 2005

(54) BRAKE SHOE WITH SPRING BRAKE MEMBER

(75) Inventors: Jason L. Annes, Chicago, IL (US); Ralph Soles, Brandon, SD (US)

(73) Assignee: Ashland Products, Inc., Lowell, IN (US)

( * ) Notice: Subject to any disclaimer, the term of this patent is extended or adjusted under 35 U.S.C. 154(b) by 0 days.

(21) Appl. No.: 10/062,302

(22) Filed: Feb. 1, 2002

(65) Prior Publication Data

US 2003/0145523 A1 Aug. 7, 2003

(51) Int. Cl.[7] ..... E05D 15/22
(52) U.S. Cl. ..... 49/181; 49/445
(58) Field of Search ..... 49/176, 181, 445, 49/447; 16/197

(56) References Cited

U.S. PATENT DOCUMENTS

| | | | |
|---|---|---|---|
| 1,226,145 | A | 5/1917 | Taylor |
| 1,272,039 | A | 7/1918 | Hausmann |
| 1,873,066 | A | 8/1932 | Stewart |
| 2,308,621 | A | 1/1943 | Levyn |
| 2,500,849 | A | 3/1950 | Menns |
| 3,012,292 | A | 12/1961 | Brengman |
| 3,108,335 | A | 10/1963 | Osten, Sr. |
| 3,118,190 | A | 1/1964 | Love |
| 3,146,501 | A | 9/1964 | Peters |
| 3,157,917 | A | 11/1964 | Peters |
| 3,197,819 | A | 8/1965 | Trout |
| 3,348,335 | A | 10/1967 | Mauro |
| 3,399,490 | A | 9/1968 | Hettinger |
| 3,429,071 | A | 2/1969 | Phillips |
| 3,434,236 | A | 3/1969 | Weidner et al. |
| 3,462,882 | A | 8/1969 | Brown, Jr. |
| 3,466,803 | A | 9/1969 | Packett |
| 3,789,549 | A | 2/1974 | Yip |
| 3,844,066 | A | 10/1974 | Nobes |
| 4,068,406 | A | 1/1978 | Wood |
| 4,222,201 | A | 9/1980 | Yanessa |
| 4,227,345 | A | 10/1980 | Durham, Jr. |
| 4,337,597 | A | 7/1982 | Struckmeyer |
| 4,452,012 | A | 6/1984 | Deal |
| 4,506,478 | A | 3/1985 | Anderson |
| 4,559,739 | A | 12/1985 | Bayer |
| 4,590,708 | A | 5/1986 | Campodonico |
| 4,610,108 | A | 9/1986 | Marshik |
| 4,644,691 | A | 2/1987 | Wright, Thomas M. |
| 4,683,675 | A | 8/1987 | Guelck |
| 4,683,676 | A | 8/1987 | Sterner, Jr. |
| 4,718,194 | A | 1/1988 | FitzGibbon et al. |
| 4,813,180 | A | 3/1989 | Scalzi |

(Continued)

*Primary Examiner*—Gregory J. Strimbu
(74) *Attorney, Agent, or Firm*—Wallenstein Wagner & Rockey, Ltd.

(57) ABSTRACT

A brake assembly (24) locks a slidable sash window (14) within a track (16) of a frame (12). The track (16) has a pair of spaced apart, opposed sidewalls (20), the brake assembly (24) includes a slider body (28) adapted for slidable motion within the track (16). The slider body (28) has a central opening (34) extending from a front face (36) to a rear face (38) and has a side opening (46) adjacent to the central opening (34). The assembly also includes a brake member (30) comprising a spring having a braking surface (58), and mounted within the slider body (28) such that the braking surface (58) is adapted for reciprocal lateral movement through the side opening (46). The assembly (24) further includes a cam (32) positioned in the central opening (34), wherein the slider body (28) receives and retains the brake member (30) and the cam (32) is rotatable in the central opening (34) for laterally biasing the braking surface (58) for movement through the side opening (46) wherein the braking surface (58) is adapted to frictionally engage one of the opposed side walls (20).

30 Claims, 8 Drawing Sheets

U.S. PATENT DOCUMENTS 4,854,077 A 8/1989 Rogers et al.
4,888,915 A 12/1989 Goldenberg
4,922,657 A 5/1990 Foss
4,958,462 A 9/1990 Cross
5,027,557 A 7/1991 May
5,058,321 A 10/1991 Harbom et al.
5,127,192 A 7/1992 Cross
5,168,665 A 12/1992 Goldenberg
5,210,976 A 5/1993 Cripps
5,237,775 A 8/1993 Hardy
5,251,401 A 10/1993 Prete et al.
5,301,467 A 4/1994 Schmidt et al.
5,371,971 A 12/1994 Prete
5,377,384 A 1/1995 Riegelman
5,383,303 A 1/1995 Nakanishi et al.
5,414,960 A 5/1995 O'Donnell et al.
5,530,991 A 7/1996 deNormand et al.
5,632,117 A 5/1997 Prete et al.
5,661,927 A 9/1997 Polowinczak et al.
5,697,188 A 12/1997 Fullick et al.
5,704,165 A 1/1998 Slocomb et al.
5,737,877 A 4/1998 Meunier et al.
5,802,767 A 9/1998 Slocomb et al.
5,806,243 A 9/1998 Prete et al.
5,829,196 A 11/1998 Maier
5,927,014 A 7/1999 Goldenberg
5,943,822 A 8/1999 Slocomb et al.
6,032,417 A 3/2000 Jakus et al.
6,041,476 A 3/2000 deNormand
6,119,398 A 9/2000 Yates, Jr.

BRAKE SHOE WITH SPRING BRAKE MEMBER

TECHNICAL FIELD

This invention relates to a pivoting and sliding device for slidable door or window assemblies mounted in a frame. More particularly, it relates to a brake shoe having a cam activated spring locking mechanism that is activated when pivoting a slidable door or window out of the plane of the frame.

BACKGROUND OF THE INVENTION

It is known in the prior art of slidable window sash and frame construction to have vertical and horizontal sliding windows adapted to be pivoted out of the frame when desired. For tasks such as cleaning the window from within the building in which the window is installed, a pivoting window must be securely arrested from sliding at the pivot point to prevent balance assemblies associated with the window assembly from propelling the sash upwards. This can damage the sash and cause injury to the user.

Pivot mechanisms have included movable pins mounted on the edge of the sash which may be extended outwardly to engage holes in the frame about which the sash may be pivoted. U.S. Pat. No. 4,222,201 discloses a pivoting mechanism wherein a pair of spring biased pins are manually extended outward. Mating apertures in the tracks receive the pins, providing an axis of rotation. The sash may then be pivoted. After the window is pivoted back into the plane of the frame, the pins are retracted and secured in place by a screw to allow the sash to freely slide within the frame.

U.S. Pat. No. 5,058,321 discloses a mechanism wherein spring biased pivot pins are freed for selective extension into apertures formed in a frame by rotating said pins. The pins are retracted by rotation and secured in place by an arrangement of detents.

It is also known in the prior art to provide a pivoting arrangement which achieves automatic arresting of the sliding motion of a slider body in a track in response to the commencement of the pivoting of the window sash. U.S. Pat. No. 4,610,108 discloses such a device which incorporates a U-shaped spring member within a block member, wherein a pin extends from a window sash. A cam member is incorporated in the block and receives the pivot pin extending from the window sash. The cam member is rotatably engagable with the U-shaped spring member to lock the block in position upon pivoting the window sash. The cam member cams the U-shaped spring member wherein the outwardly opposed serrated tips are forced outwardly through slots in the block for penetration into the track wall by the serrated tips. Although simple to operate, experience has shown that a pivot arrangement of this type may not develop adequate arresting force. In addition, the serrated tips being engagable with and normal to the track wall, can become jammed in the wall after the window sash is returned to its slidable position. This configuration can also damage certain track constructions.

The present invention is provided to solve these and other problems.

SUMMARY OF THE INVENTION

According to one aspect of the invention, a sash balance brake assembly is disclosed for locking a slidable sash window or door within a track of a frame, the track having a pair of spaced apart, opposed sidewalls. The assembly has a slider body adapted for slidable motion within the track. The slider body has a central opening extending from a front face to a rear face and a pair of side openings. The assembly also has a brake member comprised of a spring having two braking surfaces, the brake member being mounted within the slider body such that one braking surface each is adapted for reciprocal lateral movement through a respective side opening. The assembly further has a cam positioned in the central opening. The slider body is adapted to receive and retain the brake member and the cam is adapted to be rotatable in the central opening for laterally biasing the braking surfaces for movement through the side openings for frictional engagement of each braking surface with a respective side wall. According to another aspect of the invention, the spring has two end portions, each having a first segment and a second segment. The first segment curves inwardly and the second segment curves outwardly, wherein the braking surfaces are each located on a respective convex surface of the second segment.

According to another aspect of the invention, the braking surfaces are serrated.

According to another aspect of the invention, the slider body has a plurality of retaining tabs for holding the brake member within the slider body.

According to another aspect of the invention, the cam has a nipple adapted for maintaining the cam within the slider body.

According to another aspect of the invention, the brake member is comprised of a pair of brake pads connected by a resiliently flexible member. The brake member is mounted within the slider body such that one brake pad each is adapted for reciprocal lateral movement through a respective side opening. The assembly further has a cam positioned in the central opening. The slider body is adapted to receive and retain the brake member and the cam is adapted to be rotatable in the central opening for laterally biasing the brake pads for movement through the side openings for frictional engagement of each brake pad with a respective side wall.

Other features and advantages of the invention will be apparent from the remainder of this specification.

BRIEF DESCRIPTION OF THE DRAWINGS

The pivoting and sliding device of the invention will now be described with reference to the accompanying drawings, in which.

DETAILED DESCRIPTION

Figure 1:
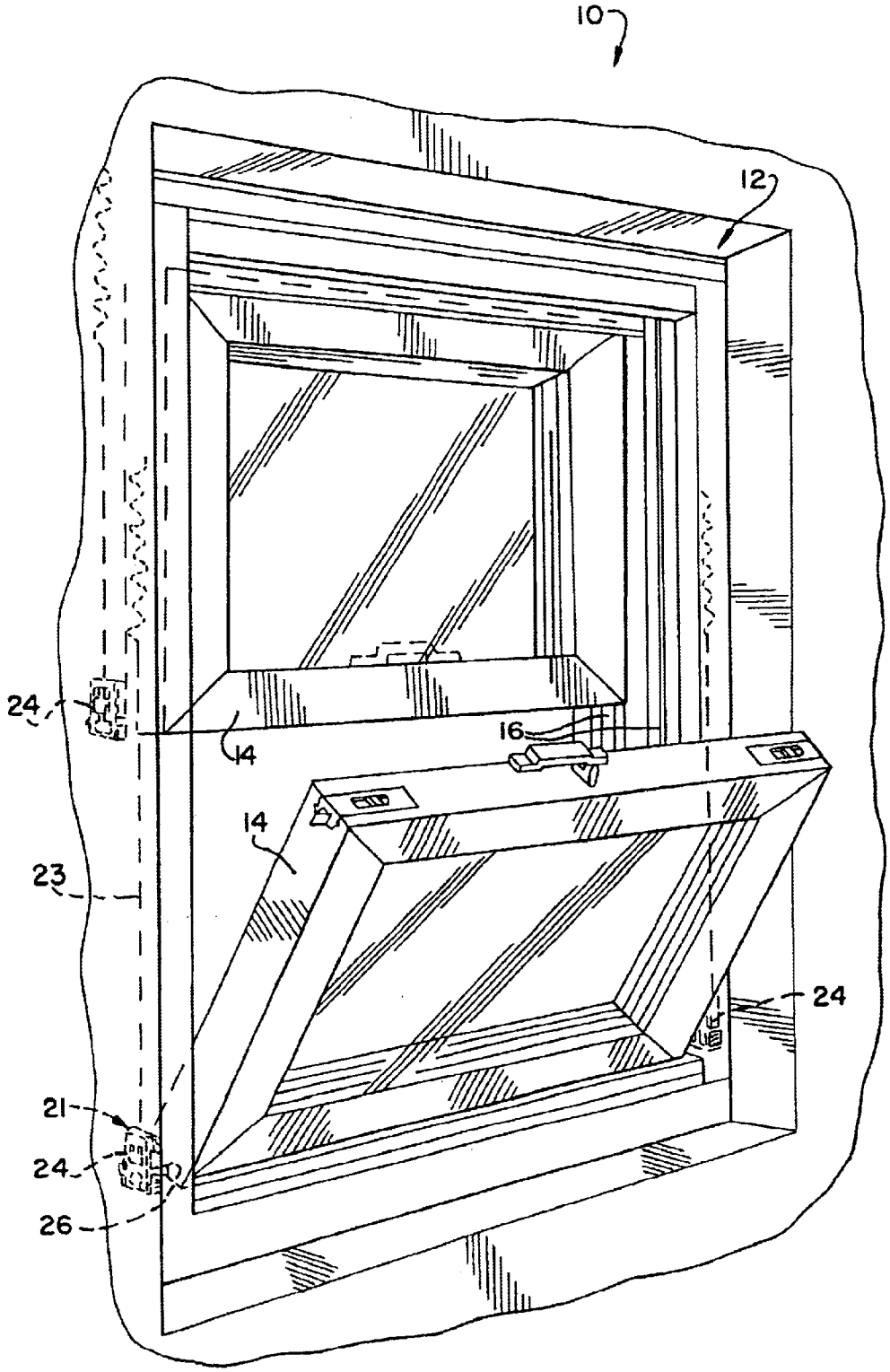
FIG. 1 is a perspective view of a double hung window assembly with the present invention shown in phantom.
Figure 3:
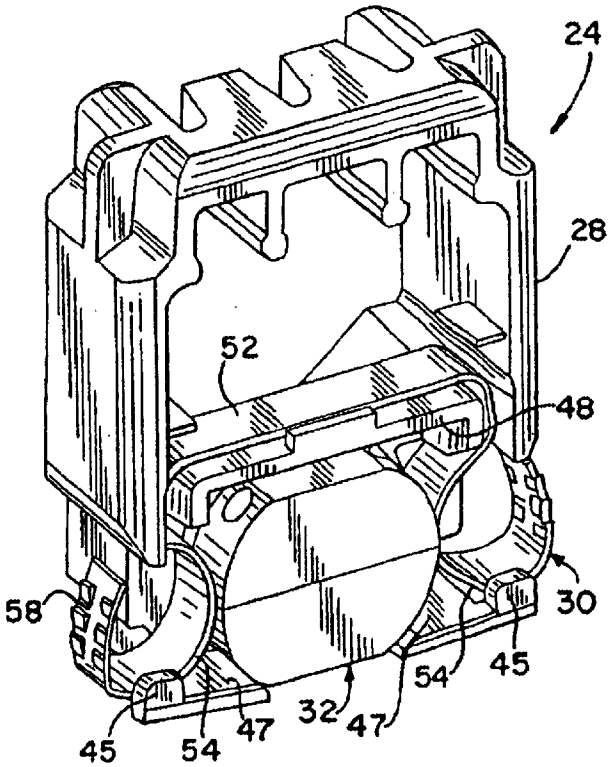
FIG. 3 is a rear perspective view of the brake shoe assembly with the spring brake member of the present invention.
Figure 2:
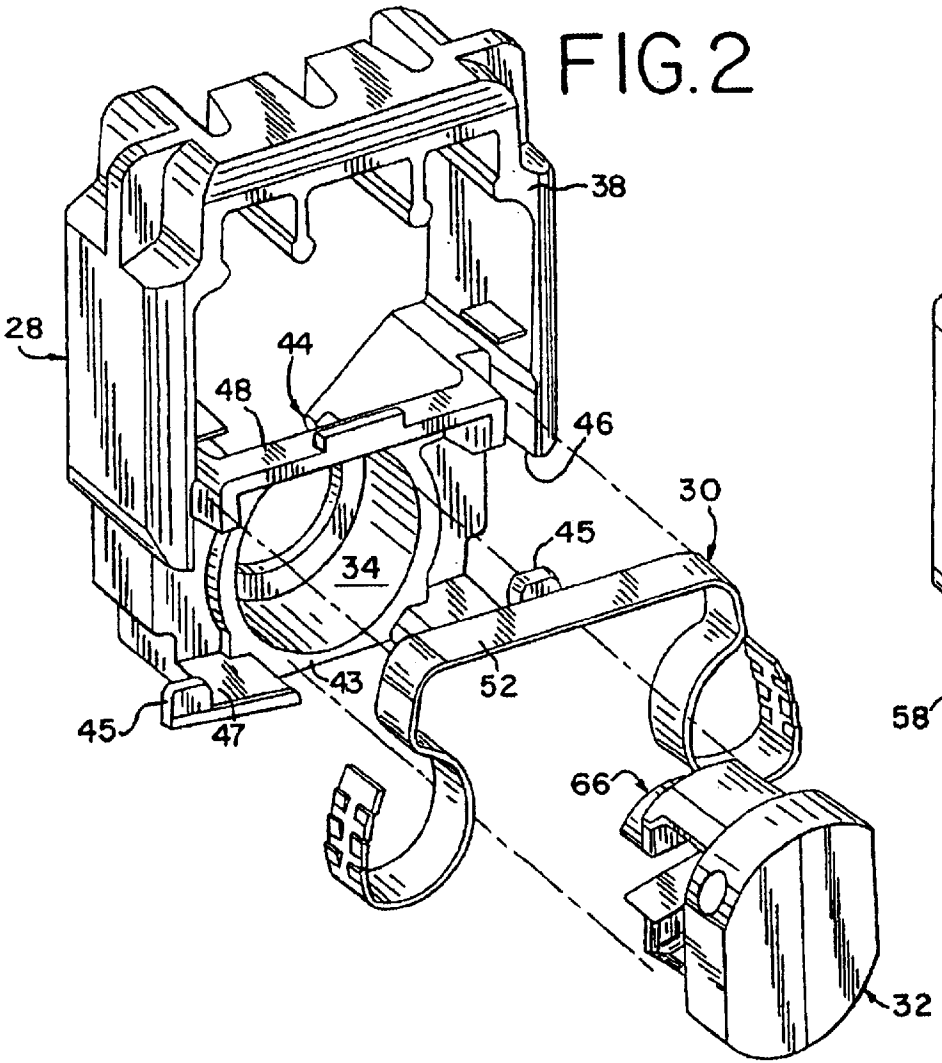
FIG. 2 is an exploded rear perspective view of a brake shoe assembly having a spring brake member of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, there is shown a double hung window assembly 10 which includes a window frame 12 and a pair of window sashes 14.

Figure 15:
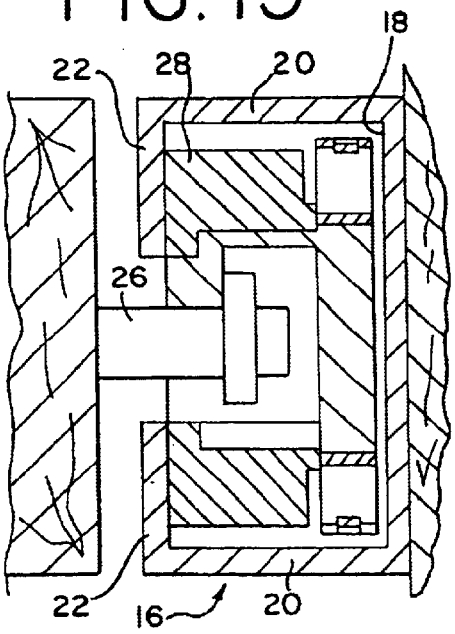
FIG. 15 is a cross section of the brake shoe assembly of the present invention slidably mounted within a track of a window frame and its spring brake member in its retracted or slidable position.
Figure 16:
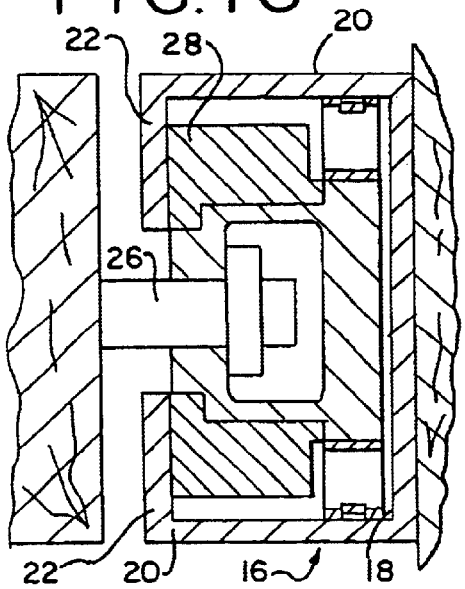
FIG. 16 is a cross section of the brake shoe assembly of the present invention slidably mounted within a track of a window frame and its spring brake member in its retracted or slidable position.

The window frame 12 includes a pair of generally parallel tracks 16, cross sections of which can be seen in FIGS. 15 and 16. The track 16 includes a base 18 and a pair of side walls 20 extending generally parallel from the base 18. Also included is a shoulder 22 extending from each sidewall 20 towards the other sidewall and generally parallel with the base 18.

The sash 14, as shown in FIG. 1 is transversely disposed between the tracks 16 for slidable movement in the plane defined by the tracks 16. Located at the lower end of parallel transverse sides of sash 14 is a pair of sash balance/brake shoe assemblies 21.

The sash balance/brake shoe assemblies 21 provide a generally upward bias on transverse sides of the sash 14. The sash balance/brake shoe assembly 21 generally includes a balance member 23 connected to a brake shoe assembly 24. The balance member 23 can come in different forms known in the art such as, for example, block and tackle balance, curl springs, spiral springs and the like. A pivot pin 26 (shown also in FIGS. 15–16) extends from the lower end of each transverse side of the sash 14 and is operably received by the brake shoe assemblies 24.

Referring to FIGS. 2–7, the brake shoe assembly 24 is adapted for slidable mounting in the track 16 and generally includes a slider body 28, a brake member 30 and a cam 32.

Figure 9:
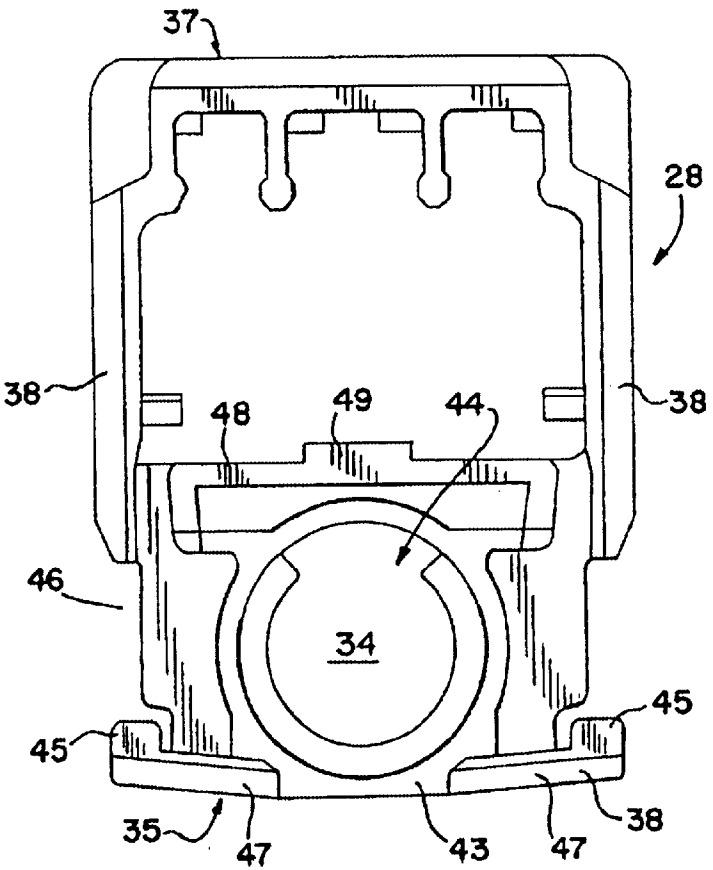
FIG. 9 is a rear elevation of the slider body of the assembly of FIG. 3.
Figure 8:
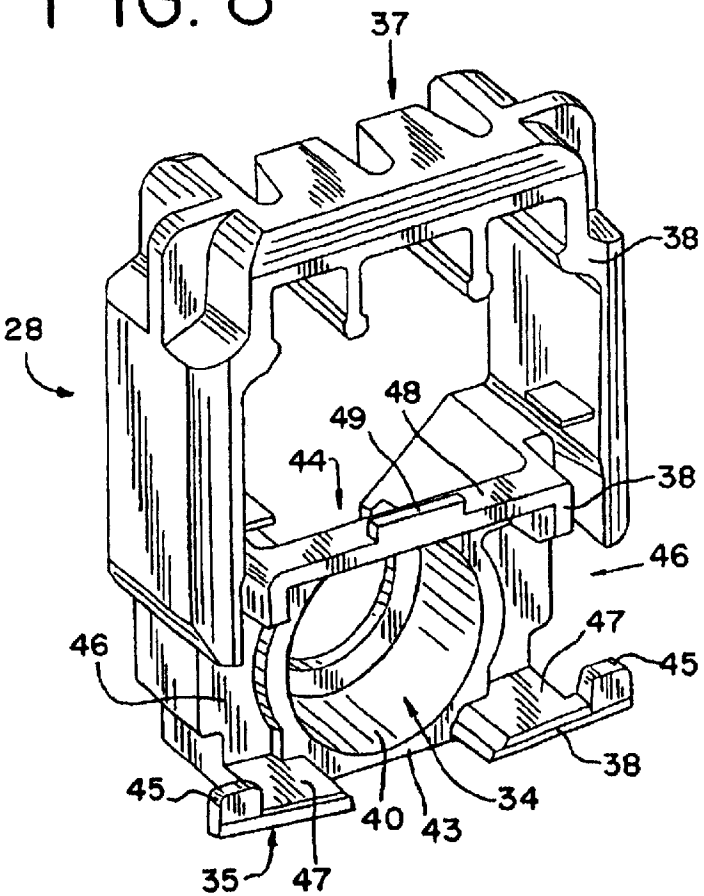
FIG. 8 is a rear perspective view of a slider body of the assembly of FIG. 2.
Figure 10:
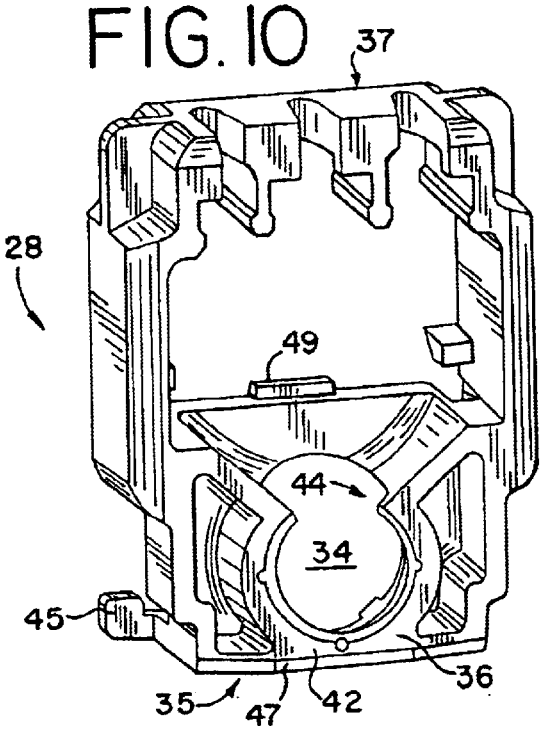
FIG. 10 is a front perspective of the slider body of the assembly of FIG. 3.

As shown in FIGS. 15–16, the slider body 28 has dimensions to fit within the track 16 as described above. Referring to FIGS. 8–10, the slider body 28 preferably is manufactured from a tough material such as nylon, although other suitable materials can be used. The slider body 28 includes a central opening 34 located near a lower end 35 of the slider body 28. The central opening 34 extends from a front face 36 to a rear face 38. An upper end 37 of the slider body 28 is adapted for connection to the various types of balance members 23 discussed above.

The central opening 34 is defined by a generally cylindrical wall 40 having a front end 42 and a rear end 43. The cylindrical wall 40 has a slot 44 adapted to assist in receiving and retaining the cam 32, to be more fully described below.

As further shown in FIGS. 8–10, the slider body 28 has a pair of lateral or side openings 46 in proximity to the central opening 34. The openings 46 are adapted to receive the brake member 30 as show in FIGS. 2–3. The slider body 28 also has a lateral cross member 48 with a retaining tab 49 formed centrally thereon. The slider body 28 has a bottom wall 47. The bottom wall 47 has retaining tabs 45 on each end thereof to assist in retaining the brake member 30 within the slider body 28.

Figure 13:
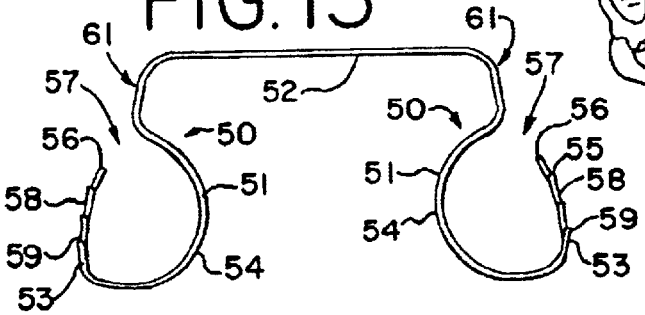
FIG. 13 is an elevation of the spring brake member of the assembly of FIG. 3.
Figure 14:
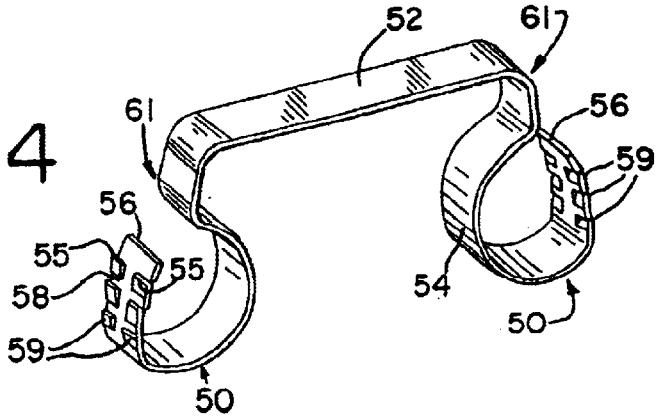
FIG. 14 is a perspective view of the spring brake member of the assembly of FIG. 3.

As shown in FIGS. 13–14, the brake member 30 is a spring formed from a single flat piece of steel having two end portions 50. The brake member 30 has resiliently flexible characteristics. However, it is noted that the brake member 30 may be formed from any material or combination having similar resiliently flexible characteristics or from a plurality of contiguous pieces of steel or other such material. The brake member 30 has a base portion 52 that is straight having two end portions 50. In one embodiment, the base portion 52 has rounded or curved portions 61 leading into each end portion 50. Each end portion 50 is gibbous-like and generally has an inverted S-shape. Each end portion 50 has a first segment 51 and a second segment 53. The first segment 51 curves inwardly and has a convex surface 54. The second segment 53 curves outwardly and has a convex surface which forms a braking surface 58. The outer portions 50 also each have a tip 56 at distal ends of the brake member 30. As shown in the drawings, the tips 56 curl roughly inward to point generally towards the base portion 52 of brake member 30.

Each end portion 50 of the brake member 30 has generally a gibbous-like shape. As can be seen in FIG. 13, there remains an open space 57 between each tip 56 and the brake member 30. The open space 57 permits improved performance of the brake member 30 as it allows for increased resilient flexibility of each end portion 50 of the brake member 30.

As depicted, each braking surface 58 includes a series of serrations 59. In one preferred embodiment, the brake surface 58 has a configuration of three pairs of serrations 59, as shown in FIG. 14. Each serration 59 extends away from the braking surface 58 at an oblique angle and towards the direction in which any counterbalance force is supplied by the balance member 23. Each serration 50 also has a sharply defined edge 55 for effective braking characteristics. However, other arrangements and configurations may be suitable. For example, other preferred embodiments may include serrations 59 with circular, rectangular, or triangular cross sections or any combination thereof. Additional preferred embodiments may include frictional protrusions, protuberances or grooves, rather than the serrations 59 depicted.

Figure 11:
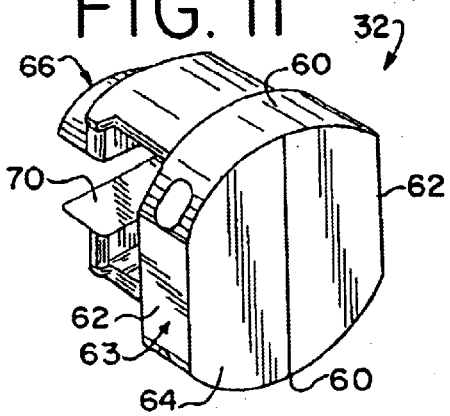
FIG. 11 is a rear perspective of a cam of the assembly of FIG. 3.
Figure 12:
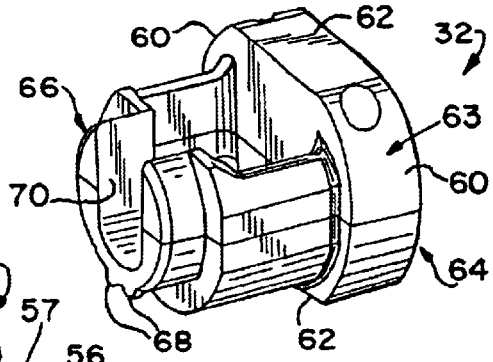
FIG. 12 is a front perspective of the cam of the assembly of FIG. 3.

The rotatable cam 32 (FIGS. 11 & 12) is formed from a similar material as that of the slider body 28 and includes a generally cylindrical body 29, although other geometries may be utilized. However, other materials such as metal may also be used. A first enlarged end 64 of the cam 32 has a pair of diametric curved or arcuate surfaces 60 and a pair of planar surfaces or flats 62 located on a peripheral surface 63. As shown in FIG. 12, integrally formed on a second end 66 of the cam 32 is a pair of nipples 68. The nipples 68 are located in close proximity to one another. The cam 32 is adapted to operably receive the pivot pin 26 (FIGS. 15–16). As shown, an axial slot 70 is formed through the second end 66 and terminates at the first enlarged end 64.

As can best be understood by reference to FIGS. 2–7, the brake member 30 is inserted into the slider body 28 from the direction of the rear face 38. When the brake member 30 is received by the slider body 28, the base portion 52 is in close abutment with the lateral cross member 48. Also, the end portions 50 are located in the side openings 46. The retaining tabs 49 and 45 cooperate to hold the brake member 30 within the slider body 28.

Also from the direction of the rear face 38, the second end 66 of the cam 32 is inserted into the central opening 34 such that the nipples 68 may pass through the gap 44. Once the nipples 68 have passed beyond the front end 42, the cam 32 is rotated. This results in the nipples 68 cooperating with the front end 42 to limit axial movement of the cam 32 in the direction of the rear face 38. Axial movement of the cam 32 in the direction of the front face 36 is also limited. This is achieved through the close abutment of the rear end 43 of the cylindrical wall 40 and the first enlarged end 64 of the cam 32. Once the cam 32 is inserted in the slider body 28 as described, the first enlarged end 64 is immediately adjacent to the end portions 50.

Figure 5:
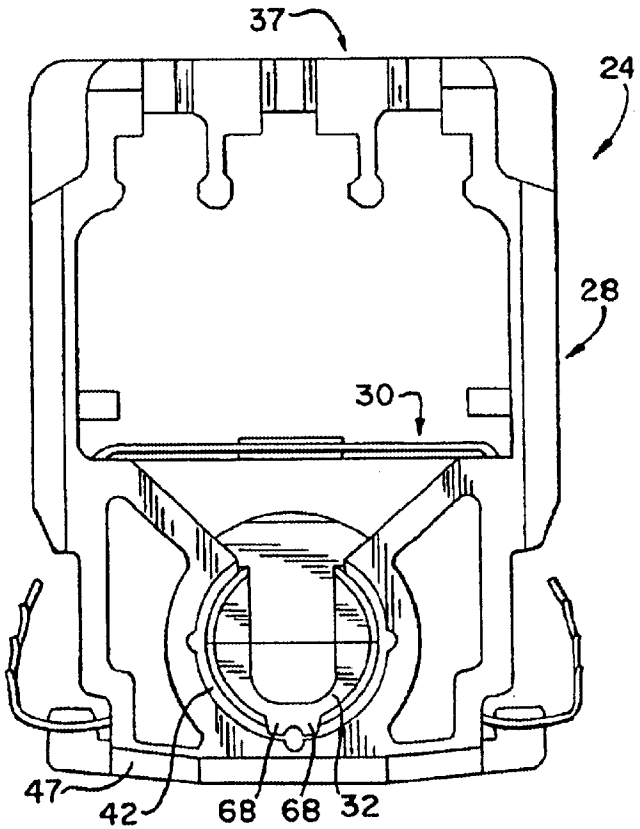
FIG. 5 is a front elevation of the assembly of FIG. 3 with the brake member in its extended position or braking position.
Figure 4:
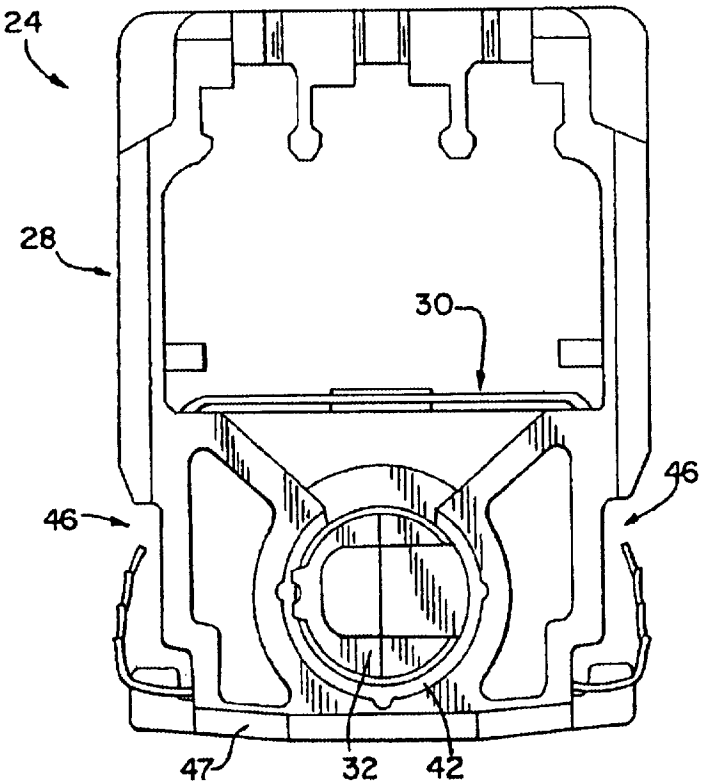
FIG. 4 is a front elevation of the assembly of FIG. 3 with the brake member in its retracted or slidable position.
Figure 7:
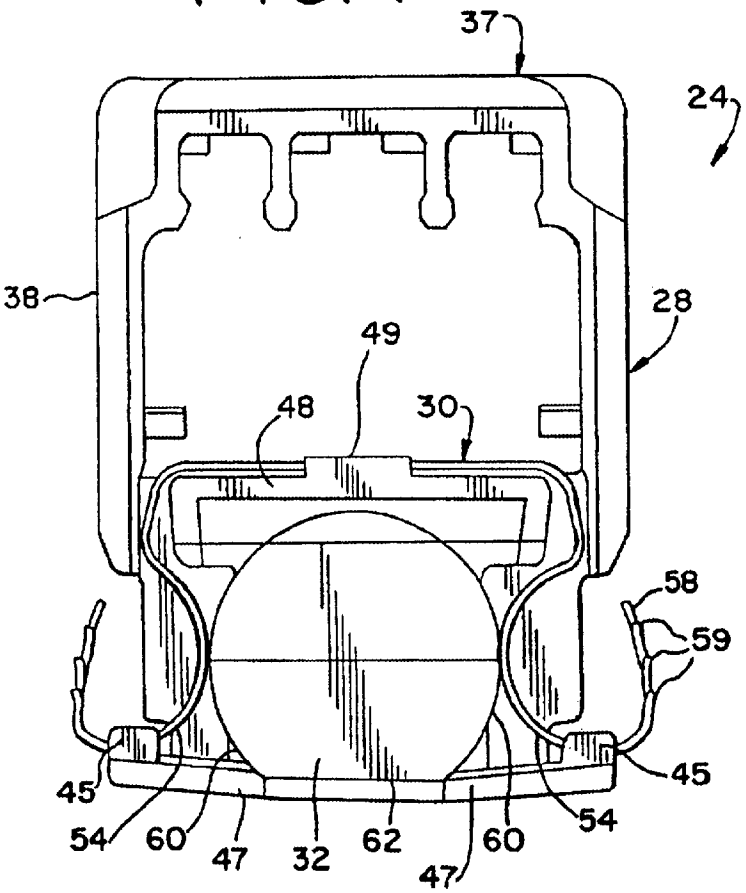
FIG. 7 is a rear elevation of the assembly of FIG. 3 with the brake member in its extended position or braking position.
Figure 6:
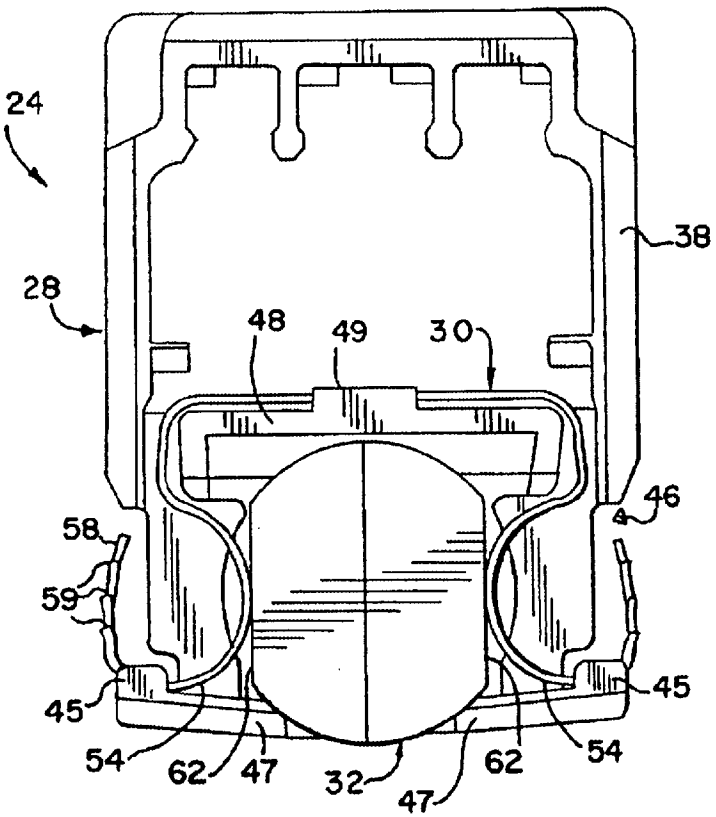
FIG. 6 is a rear elevation of the assembly of FIG. 3 with the brake member in its retracted or slidable position.

When the slider body 28 is in a freely slidable position within the track 16 (FIGS. 4, 6 & 15), the planar surfaces 62 are in close abutment with a respective convex surface 54 of the brake member 30 and the braking surfaces 58 remain within the side openings 46. Rotation of the sash 14 out of the frame 12 results in corresponding rotation of the pivot pin 26. This in turn rotates the cam 32 causing the planer surfaces 62 and the arcuate surfaces 60 to cooperate to engage, or cam, the respective convex surface 54 of the first segment 51 of the spring 30. This engagement causes a lateral biasing of the braking surfaces 58 on the second segments 53 through the side openings 46. This causes serrations 59 of the braking surfaces 58 to frictionally engage respective side walls 20. This frictional engagement prevents slidable motion of the slider body 28 within the track 16 (FIGS. 5, 7 & 16). As can be seen, the serrations 59 of the braking surfaces 58 extend from the second segments 53 at an oblique angle generally in the direction of the upper end 37. This improves their ability to frictionally engage the side walls 20.

Upon rotation of the sash 14 back to its slidable position within the frame 14, the planar surfaces 62 of the cam 32 are brought into cooperation with the first segments 51. This allows the resilient flexibility of the brake member 30 to return the braking surfaces 58 to a position within the side openings 46. This frictionally disengages the serrations 59 from the side walls 20, thereby returning the slider body 28 to a freely slidable position within the track 16.

Figure 17:
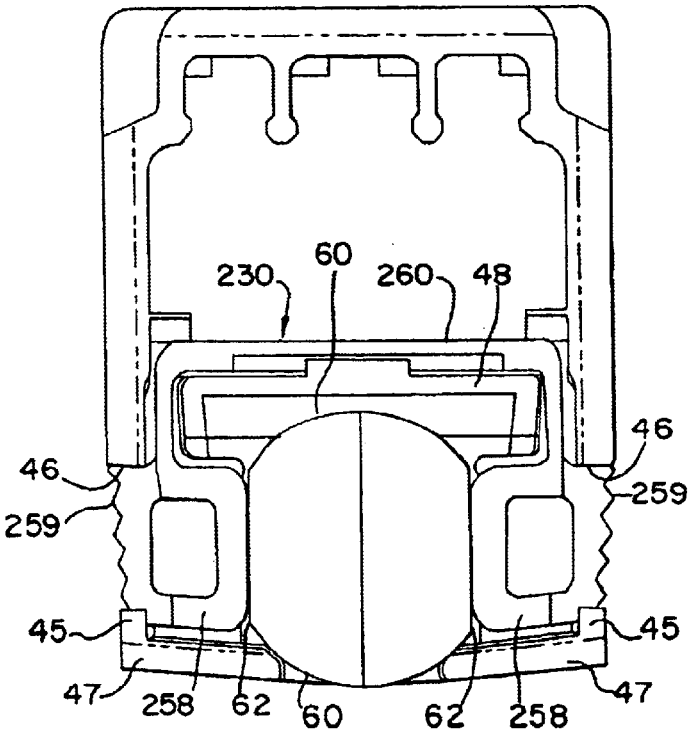
FIG. 17 is a rear elevation of an additional embodiment of the brake shoe with spring brake member assembly of the present invention.

An additional embodiment is shown in FIG. 17. In this second embodiment, the brake member 230 is formed by two brake pads 258, each having formed thereon a series of frictional grooves 259. The brake pads 258 are connected by a resiliently flexible member 260. The brake member 230 is received by the slider body 28 such that the flexibly resilient member 260 is in close abutment with the lateral cross member 48, the brake pads 258 are mounted within the side openings 46, and the retainer tabs 45, 49 retain and hold the brake member 230 within the slider body 28.

In operation, rotation of the cam 32 from a slidable position, similar to that of the first described embodiment, causes the arcuate surfaces 60 to cooperate with the brake pads 258. This cooperation results in lateral biasing of the brake pads 258 and frictional engagement of the frictional grooves 259 with the respective side walls 20. This frictional engagement slidably locks the slider body 28 within the track 16. Upon rotation of the cam 32 back to its slidable position, the planar surfaces 62 cooperate with the brake pads 258. This allows the resiliently flexible member 260 to return the brake pads 258 to a position within the side openings 46. This slidably releases the frictional grooves 259 from their respective side walls 20 to allow slidable movement of the slider body 28.

Figure 18:
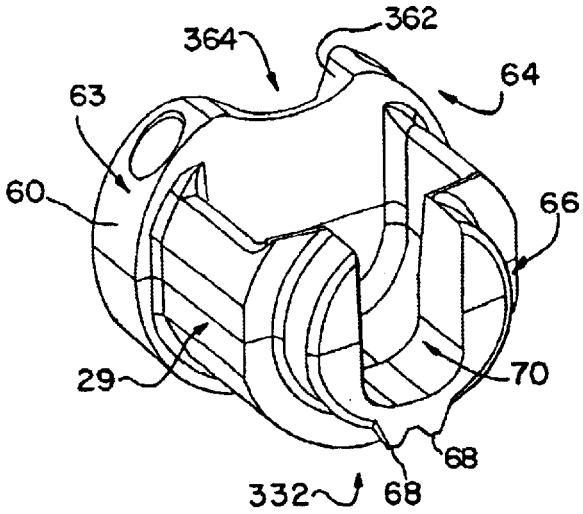
FIG. 18 is a front perspective view an additional embodiment of a cam of the present invention.
Figure 19:
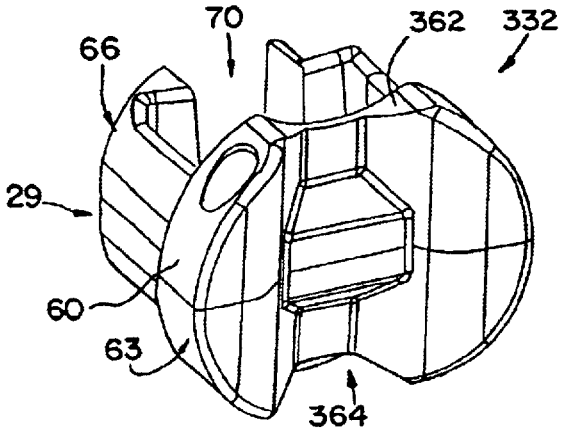
FIG. 19 is a rear perspective view of the cam of FIG. 18.
Figure 20:
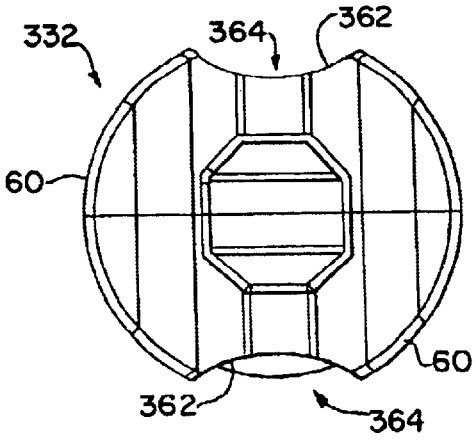
FIG. 20 is a rear elevation view of the cam of FIG. 18.

An additional embodiment of the cam is depicted in FIGS. 18–20 and is designated by the reference numeral 332. The cam 332 is adapted to fit in and function with the slider body 28 and brake member 30 in a manner generally identical to that of the above described cam 32. The cam 332 includes a generally cylindrical body 29. The cam 332 has a first enlarged end 64 that has a pair of opposed arcuate surfaces 60 and a pair of opposed concave surfaces 362. The concave surfaces 362 define a recess 364. Integrally formed on a second end 66 of the cam 332 is a pair of nipples 68. The nipples 68 are located in close proximity to one another. The cam 332 is adapted to receive the pivot pin 26 (FIGS. 15–16). As shown, an axial slot 70 is formed through the second end 66 and terminates at the first enlarged end 64. An alternative preferred embodiment includes one concave surface 362. It is noted that those skilled in the art will recognize that the enlarged end 64 of the cam 32 or the cam 332 can be eliminated and that the camming surfaces do not need to be located at an end of the cam to practice the present invention.

The cam 332 is assembled into the brake shoe assembly 24 in the same manner as that described above with respect to the cam 32.

As can be understood when referring to FIGS. 10–14 and 18–20, when the cam 332 is assembled within the slider body 28 and in its slidable position, the concave surfaces 362 are in close abutment with a respective convex surface 54 of the brake member 30. In other words, the recesses 364 each receive, in confronting relation, a respective first segment 51 of the brake member 30. In this position, the braking surfaces 58 remain within the side openings 46. Rotation of the cam 332 in a manner similar to that described above, causes the concave surfaces 362 and the arcuate surfaces 60 to cooperate to engage, cam, or laterally bias the respective convex surface 54 of the first segment 51 of the spring 30. This engagement causes a lateral biasing of the braking surfaces 58 on the second segments 53 through the side openings 46. This causes serrations 59 of the braking surfaces 58 to frictionally engage respective side walls 20, as previously described.

Use of the concave surfaces 362 in place of the planer surfaces 62, results in a quicker lateral biasing of the braking surfaces 58 upon rotation of the cam 332. That is, the lateral biasing of the braking surfaces 58 occurs through a smaller degree of rotation of the cam 332 than can be achieved by the cam 32 that incorporates planer surfaces 62. This occurs because upon rotation of the cam 332, the arcuate surface 60 engages the first segment 51 of the brake member 30 to begin the camming action. Thus, braking of the brake assembly 24 within the track 16 is optimized.

While the specific embodiments and various details thereof have been illustrated and described, numerous modification come to mind without significantly departing from the spirit of the invention and the scope of protection is only limited by the following claims.

We claim:

1. A brake assembly for locking a slidable sash window within a track of a frame, the track having a pair of spaced apart, opposed sidewalls, the assembly comprising:

a slider body adapted for slidable motion within the track, the slider body having a central opening extending from a front face to a rear face of the slider body and having a side opening adjacent to the central opening;

a brake member comprising a spring having a tip at a distal end thereof, the spring further having a curved braking surface adjacent the tip, the brake member mounted within the slider body such that the curved braking surface is adapted for reciprocal lateral movement through the side opening;

a cam positioned in the central opening;

wherein the slider body receives and retains the brake member and the cam is rotatable in the central opening for laterally biasing the curved braking surface for said movement through the side opening wherein the braking surface is adapted to frictionally engage one of the opposed side walls.

2. The brake assembly of claim 1 wherein the slider body further comprises a second side opening adjacent to the central opening and the brake member further comprises a second braking surface adapted for reciprocal lateral movement through the second side opening.

3. The brake assembly of claim 1 wherein the spring further comprises an end portion having a first segment and a second segment, the first segment curving inwardly and the second segment curving outwardly, wherein the curved braking surface is located on the second segment.

4. The brake assembly of claim 1 wherein the curved braking surface is serrated.

5. The brake assembly of claim 1 wherein the curved braking surface has a plurality of serrations.

6. The brake assembly of claim 5 wherein the plurality of serrations comprises a pair of serrations.

7. The brake assembly of claim 5 wherein the plurality of serrations comprises three pair of serrations.

8. The brake assembly of claim 1 wherein the curved braking surface has a frictional protuberance.

9. The brake assembly of claim 1 wherein the slider body has a retaining tab adapted for holding the brake member within the slider body.

10. The brake assembly of claim 1 wherein the slider body has a lateral cross member and the spring has a base portion in close abutment with the lateral cross member.

11. The brake assembly of claim 10 further comprising a retaining tab on the lateral cross member for retaining the brake member in the slider body.

12. The brake assembly of claim 1 wherein the slider body has a plurality of retaining tabs for holding the brake member within the slider body.

13. The brake assembly of claim 1 wherein the cam has a nipple adapted to engage an end surface of the central opening for maintaining the cam within the slider body.

14. The brake assembly of claim 1 wherein the cam has an arcuate surface and a flat surface, the cam being adapted for cooperation with the arcuate surface and the flat surface of the brake member for said movement of the braking surface through the side opening.

15. The brake assembly of claim 14 wherein the cam is further adapted for cooperation between said arcuate surface and the spring for said movement of the braking surface through the side opening.

16. A brake assembly for locking a slidable sash window within a track of a frame, the track having a pair of spaced apart, opposed sidewalls, the assembly comprising:

a slider body adapted for slidable motion within the track, the slider body having a central opening extending from a front face to a rear face of the slider body and having a side opening adjacent to the central opening;

a brake member comprising a spring having an end portion having a first segment and a second segment, the first segment curving inwardly and the second segment curving outwardly and having a curved braking surface thereon, the brake member mounted within the slider body such that the end portion is adapted for reciprocal lateral movement through the side opening;

a cam positioned in the central opening;

wherein the slider body is adapted to receive the brake member and the cam is adapted to be rotatable in the central opening for laterally biasing the end portion for said movement through the side opening wherein the curved braking surface is adapted to frictionally engage one of the opposed side walls.

17. The brake assembly of claim 16 wherein the slider body further comprises a second side opening adjacent to the central opening and the brake member further comprises a second end portion, the second end portion also having a first segment and a second segment, the first segment of the second end portion curving inwardly and the second segment of the second end portion curving outwardly, a second braking surface located on the second segment of the second end portion, wherein the cam is adapted for laterally biasing the second end portion for movement through the second side opening for frictional engagement of the second braking surface with the other one of the opposed side walls.

18. The brake assembly of claim 17 wherein at least one of the curved braking surfaces is serrated.

19. The brake assembly of claim 17 wherein at least of the curved braking surfaces has a plurality of serrations.

20. The brake assembly of claim 19 wherein the plurality of serrations comprises a pair of serrations.

21. The brake assembly of claim 19 wherein the plurality of serrations comprises three pair of serrations.

22. The brake assembly of claim 16 wherein the curved braking surface has a frictional protuberance.

23. The brake assembly of claim 16 wherein the slider body has a retaining tab adapted for holding the brake member within the slider body.

24. The brake assembly of claim 16 wherein the slider body has a plurality of retaining tabs adapted for holding the brake member within the slider body.

25. The brake assembly of claim 16 wherein the cam has a nipple adapted to engage an end surface of the central opening for maintaining the cam within the slider body.

26. The brake assembly of claim 16 wherein the cam has an arcuate surface and a flat, the arcuate surface and the flat being adapted for cooperation with the end portion for said movement of the braking surface through the side opening.

27. A brake assembly for locking a slidable sash window within a track of a frame, the track having a pair of spaced apart, opposed sidewalls, the assembly comprising:

a slider body adapted for slidable motion within the track, the slider body having a central opening extending from a front face to a rear face of the slider body and having a pair of side openings adjacent to the central opening;

a brake member comprising a spring having a pair of distal ends, at each distal end having a tip and a convex braking surface adjacent the tip at each, the brake member mounted within the slider body such that each convex braking surface is adapted for reciprocal lateral movement through a respective one of said side openings;

a cam positioned in the central opening;

wherein the slider body receives and retains the brake member and the cam is rotatable in the central opening for biasing the convex braking surfaces into frictional engagement with the opposed side walls.

28. A brake assembly for locking a slidable sash window within a track of a frame, the track having a pair of spaced apart, opposed sidewalls, the assembly comprising:

a slider body adapted for slidable motion within the track, the slider body having a central opening extending from a front face to a rear face of the slider body and having a pair of side openings adjacent to the central opening;

a brake member comprising a spring having a base portion and two end portions, each end portion having a first segment curving inwardly and a second segment curving outwardly and having a convex outer surface, each end portion having a braking surface located on the convex outer surface of the second segment with each braking surface having a plurality of serrations thereon extending from the second segment, the brake member mounted within the slider body such that one of the respective braking surfaces is adapted for reciprocal lateral movement through a respective side opening;

a cam positioned in the central opening;

wherein the slider body receives and retains the brake member and the cam is rotatable in the central opening for laterally biasing the one of the braking surfaces for movement through said respective side opening wherein the one of the braking surfaces is adapted to fictionally engage a respective one of the opposed side walls.

29. A brake assembly for locking a slidable sash window within a track of a frame, the track having a pair of spaced apart, opposed sidewalls, the assembly comprising:

a slider body adapted for slidable motion within the track, the slider body having a central opening extending from a front face to a rear face of the slider body and having a side opening adjacent to the central opening;

a brake member comprising a spring having a base portion and an end portion, the end portion having a first segment curving inwardly and a second segment curving outwardly and having a convex outer surface, the end portion further having a braking surface located on the convex outer surface of the second segment with the braking surface having a plurality of serrations thereon extending from the second segment, the brake member mounted within the slider body such that the braking surface is adapted for reciprocal lateral movement through the side opening;

a cam positioned in the central opening;

wherein the slider body receives and retains the brake member and the cam is rotatable in the central opening for laterally biasing the braking surface for said movement through the side opening wherein the braking surface is adapted to frictionally engage one of the opposed side walls.

30. A brake assembly for locking a slidable sash window within a track of a frame, the track having a pair of spaced apart, opposed sidewalls, the assembly comprising:

a slider body adapted for slidable motion within the track, the slider body having a central opening extending from a front face to a rear face of the slider body and having a side opening adjacent to the central opening;

a brake member comprising a spring having a curvilinear surface including a convex braking surface, the brake member mounted within the slider body such that the convex braking surface is adapted for reciprocal lateral movement through the side opening;

a cam positioned in the central opening;

wherein the slider body receives and retains the brake member and the cam is rotatable in the central opening for laterally biasing the convex braking surface for said movement through the side opening wherein the braking surface is adapted to frictionally engage one of the opposed side walls.

* * * * *